US007900901B2

(12) United States Patent
Abegglen

(10) Patent No.: US 7,900,901 B2
(45) Date of Patent: Mar. 8, 2011

(54) SYSTEM FOR GATHERING PRINTED PRODUCTS ALONG A GATHERING LINE FORMED BY A TRANSPORT DEVICE AND FEED DEVICES FOR THE PRINTED PRODUCTS

(75) Inventor: Christian Abegglen, Frauenfeld (CH)

(73) Assignee: Muller Martini Holding AG, Hergiswil (CH)

( * ) Notice: Subject to any disclaimer, the term of this patent is extended or adjusted under 35 U.S.C. 154(b) by 119 days.

(21) Appl. No.: 11/823,720

(22) Filed: Jun. 28, 2007

(65) Prior Publication Data

US 2008/0012195 A1 Jan. 17, 2008

(30) Foreign Application Priority Data

Jun. 30, 2006 (EP) ..... 06405280

(51) Int. Cl.

| | |
|---|---|
| ***B65H 33/04*** | (2006.01) |
| ***B65H 39/00*** | (2006.01) |
| ***B65H 5/30*** | (2006.01) |
| ***B42B 2/00*** | (2006.01) |

(52) U.S. Cl. ..... 270/52.16; 270/58.02; 270/58.03; 270/52.04; 270/52.14; 270/52.18; 270/52.26; 270/52.29

(58) Field of Classification Search ..... 270/58.02, 270/58.03, 52.04, 52.14, 52.16, 52.18, 52.26, 270/52.29

See application file for complete search history.

(56) References Cited

U.S. PATENT DOCUMENTS

| | | | | |
|---|---|---|---|---|
| 3,966,185 | A * | 6/1976 | McCain et al. | 270/37 |
| 4,395,031 | A | 7/1983 | Gruber et al. | |
| 5,112,179 | A * | 5/1992 | Chan et al. | 412/1 |
| 5,547,066 | A | 8/1996 | Chang | |
| 6,237,908 | B1 * | 5/2001 | Chang et al. | 270/52.15 |
| 6,257,566 | B1 * | 7/2001 | Dooley | 270/52.18 |

FOREIGN PATENT DOCUMENTS

| | | |
|---|---|---|
| CH | 635 046 | 3/1983 |

* cited by examiner

*Primary Examiner* — Gene Crawford
*Assistant Examiner* — Yolanda Cumbess
(74) *Attorney, Agent, or Firm* — Lucas & Mercanti, LLP; Klaus P. Stoffel

(57) ABSTRACT

A system for gathering printed products includes a transport device and feed devices for the printed products, which form a gathering line, wherein the transport device has receiving points for the printed products located at regular intervals on a revolving traction apparatus. A sensor, which monitors the functionality of the receiving points along the transport line to detect defects, is connected to a control unit, which determines the feed of the printed products to the receiving points of the transport device.

7 Claims, 2 Drawing Sheets

SYSTEM FOR GATHERING PRINTED PRODUCTS ALONG A GATHERING LINE FORMED BY A TRANSPORT DEVICE AND FEED DEVICES FOR THE PRINTED PRODUCTS

BACKGROUND OF THE APPLICATION

1. Field of the Invention

The present invention relates to a system for gathering printed products along a gathering line formed by a transport device and feed devices for the printed products, where the transport device has receiving points for the supplied printed products located at regular intervals on a revolving traction mechanism.

2. Description of the Related Art

Systems of the type indicated above are used in the further processing of printed products, namely, to gather the flat products, especially printed products, into loose stacks of material. "Flat products" are understood to be folded sheets, cards, CD/DVD-ROMs, or merchandise samples. The gathered printed products are then sent to an additional processing step, where they are usually bound with wire or glue.

Feed devices, each of which is loaded with one of the types of printed product to be gathered, are located along a horizontal transport line. Receiving points or catch elements attached at regular intervals to a revolving, driven traction mechanism are conducted past all of the feed devices during one revolution and thus loaded with the printed products. Depending on the type of gathering system, the printed products can be transported either lengthwise or crosswise to their flat sides during the gathering process. So that the printed products can be bound with glue, they are laid on top of each other in the closed state to form a stack and then glued along one side in a glue binder. A sheet-gathering machine of the standard type is disclosed in CH 635 046. If the printed products are to be stitched after gathering, they must first be opened in the middle and then laid down on top of each other in the opened state.

It is possible that, because of defective printed products or malfunctions, the receiving points can be so badly damaged that they can no longer operate properly. In systems according to the prior art, defective parts must be replaced before production can resume. Under certain conditions, this can take a long time and thus significantly delay the completion of the run. This is especially irksome when there are only a few copies left to be finished and the truck hired to deliver them is already waiting at the loading dock.

SUMMARY OF THE INVENTION

In a system for gathering flat printed products, the invention is based on the object of keeping the production process running even after certain of the receiving points of the transport device have become defective.

The object is met according to the invention in that a sensor, which detects defective receiving points on the transport device, is located along the transport line and is connected to a control unit, which determines the feed of the printed products to the receiving points of the transport device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
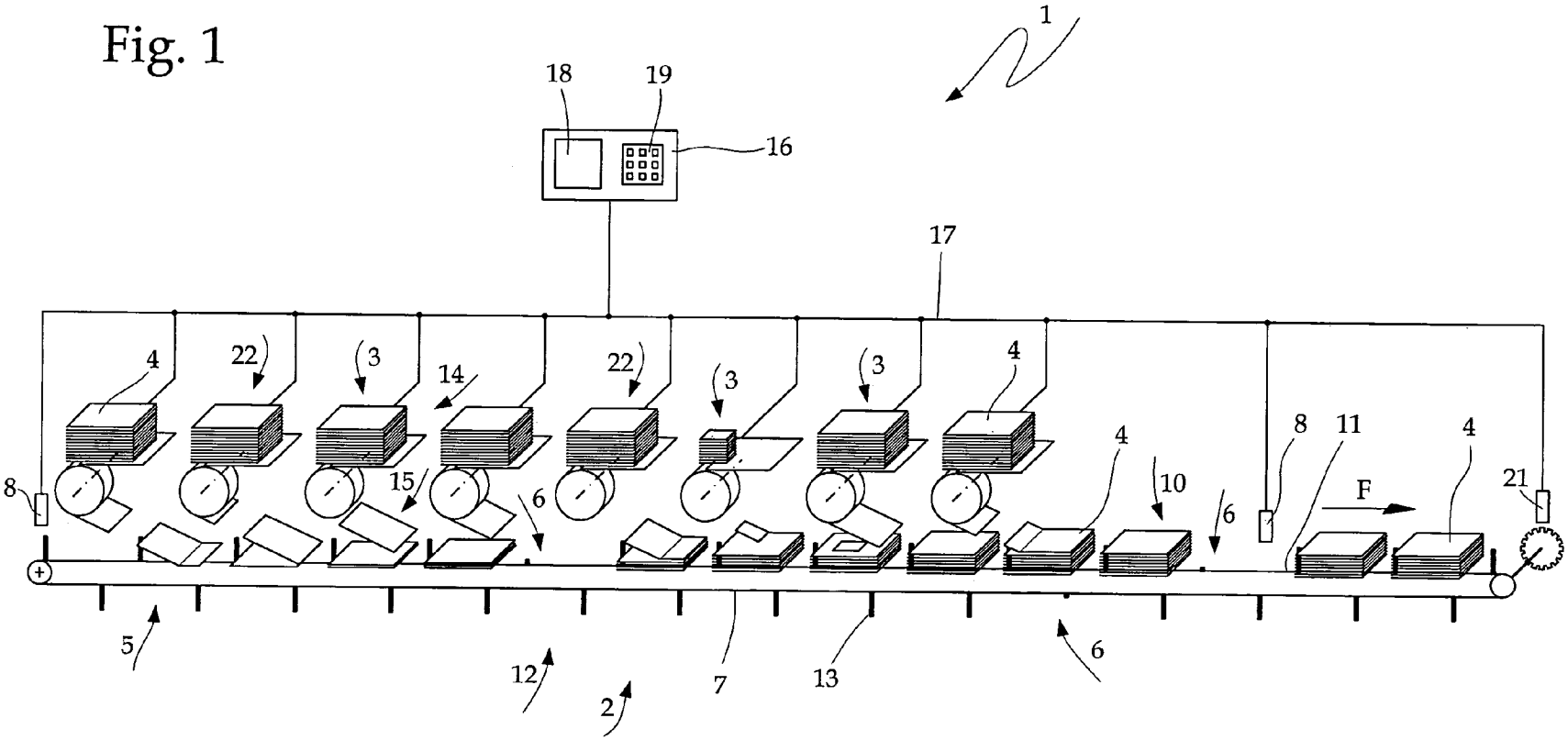
FIG. 1 is a simplified perspective view of an inventive gathering device for a glue binder.
Figure 2:
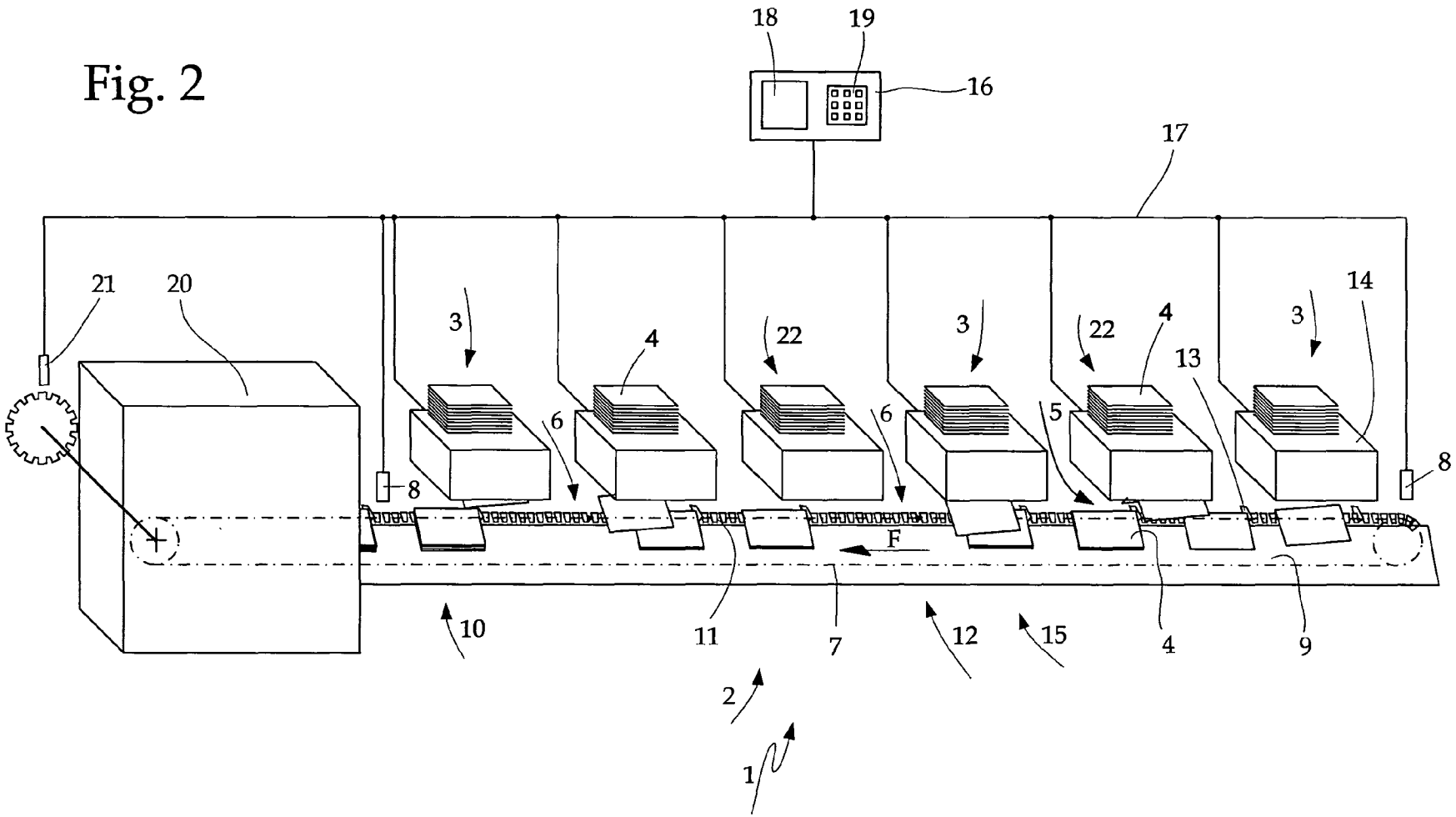
FIG. 2 is a simplified perspective view of an inventive gathering device for a saddle stitcher.

The gathering devices 1 shown in FIGS. 1 and 2 consist essentially of a transport line 2, which is formed by a transport device 12 and feed devices 3, arranged along the length of the transport device 12. The transport device 2 has means 9 (not shown in FIG. 1) on which stacks 10 of printed products 4 are formed, which are conveyed on a revolving, driven traction mechanism 7 with catch elements 13 attached at regular intervals. The gathering device 1 according to FIG. 1 could be used to gather stacks 10 for a glue binder, whereas the gathering device according to FIG. 2 could be used for a saddle stitcher with a stitching machine 20. During the gathering process for the glue binder, the various printed products 4 are laid on top of each other by the feed devices 3, located along the line of the transport device 12, so that the stacks 10 are complete by the time they reach the end of the transport device 12. During the gathering process for the saddle stitcher according to FIG. 2, the printed products 4 are gathered and set down astride, in the opened state, onto a roof-shaped support surface formed by the means 9. The traction mechanism 7 is connected to a drive (not shown) and uses its working run 11 to transport the stacks 10 by means of the catch elements 13 in the transport direction F.

The feed devices 3 are preferably formed by sheet feeders 14, which take the printed products 4 individually from the stacks 22 and deposit them on feed conveyors 15, by means of which the printed products 14 are set down in the correct position on the growing stacks 10. The expert in the field is familiar with sheet feeders 14 of various types. In FIGS. 1 and 2, the sheet feeders 14 are designed as drum feeders by way of example. The lowermost printed product 4 of each stack 22 is partially removed from the stack 22 by suction means, then gripped by grippers mounted on the drums, carried away from the stack, and deposited on the feed conveyor 15, which places the printed product 4 in the correct position and at the correct speed onto the stack 10 of sheets being transported along underneath. Each feed device 3 is connected to the control unit 16, which has a keyboard 19 and a display 18 for the exchange of control signals. This can be accomplished by way of a control line 17, which, in the present example, is illustrated as a bus. It is also possible, however, to use other linking technologies for the exchange of signals known in the field of control technology. For example, each feed device 3 could be connected to the control device 16 by its own separate line.

The control unit 16 is thus able to activate or to deactivate the feed devices 3, to adjust formats, and to receive control signals from the feed devices 3, which indicate, for example, whether or not a printed product 4 of the correct thickness has been taken from the stack 22 or has been taken from the stack correctly. So that the control signals can be coordinated properly in time, at least one position sensor 21 is provided on the drive of the traction means 7; this sensor is also connected to the control unit 16 by means of a control line 17 or a separate line.

Along the gathering line 2 of the transport device 12, furthermore, sensors 8 are provided to monitor the status of the receiving points 5, 6. Thus any catch elements 13 which have been deformed or broken off completely, for example, and which cannot continue to fulfill their function can be detected. It is also conceivable, however, that the status of the catch elements and their functionality could be detected by additional components inside a receiving point 5. The sensors 8 are also connected to the control unit 16 either by the control line 17 or by separate lines.

Any known type of sensor can be used as the sensor 8. Sensors using direct optical, electrical, or mechanical detection are preferred. Sensors 8 using electrical detection are usually based on inductive or capacitive principles. Also conceivable is the use of RFID systems (Radio Frequency Identification).

The sensors 8 are preferably located before the start or after the end of the gathering line, because there the access space required for repairs is available. If, on the basis of a sensor 8, the control unit 16 establishes that a defective receiving point 6 is present, the gathering device is stopped briefly and manually loosened or emptied. The operator must now decide whether to continue the production run with one or more defective receiving points 6. The control unit 16 will assist him with this decision to the extent that, after entering the time required for the repair via the keyboard 19, it will show him on the display 18 the expected times at which production will be complete with and without the repairs. To calculate these times, the control unit 16 will take into account the number of copies still to be produced, the production speed, the repair time, the number of defective receiving points 6, and the total number of receiving points 5, 6.

While specific embodiments of the invention have been shown and described in detail to illustrate the inventive principles, it will be understood that the invention may be embodied otherwise without departing from such principles.

I claim:

1. A process for gathering printed products along a gathering line, having:

a transport device;

feed devices for the printed products, wherein the transport device and the feed devices form the gathering line, wherein the transport device has receiving points for the printed products located at regular intervals on a revolving traction mechanism;

a sensor for detecting a defective receiving point on the transport device, the sensor being located along the transport line; and a control unit connected to the sensor for determining the feed of the printed products to the receiving points of the transport device, wherein the sensor is configured for an optical, electrical, or mechanical detection of defective receiving points the process comprising:

detecting by means of the sensor any defective receiving point on the transport device, and deciding between feeding and not feeding any defective receiving point by the feed devices.

2. The process according to claim 1, comprising positioning the sensor at an end of the gathering line.

3. The system according to claim 1, wherein the sensor is located before a start of the gathering line.

4. The process according to claim 1, comprising deciding by means of a computer of the control unit, whether, on the basis of the number of copies to be produced and the determination of the number of copies remaining to be produced, a current production run is to be continued.

5. The process according to claim 4, further comprising interrupting by means of the control unit a current production run so that a defective receiving point can be repaired.

6. The process according to claim 1 used in a gathering machine for the production of glue-bound book blocks.

7. The process according to claim 1 used in a saddle stitcher for the production of wire-stitched printed products.

* * * * *